United States Patent [19]

Fernaeus et al.

[11] 4,101,255

[45] Jul. 18, 1978

[54] APPARATUS FOR MANUFACTURING WAVE-SHAPE BUILDING BLOCKS

[76] Inventors: Sven Evert Fernaeus, Frejavägen 80, 191 46, Sollentuna; Erik Anselm Jonsson, Box 3411, Yokelsbo, 820 40, Järvso, both of Sweden

[21] Appl. No.: 769,430

[22] Filed: Feb. 17, 1977

Related U.S. Application Data

[62] Division of Ser. No. 605,314, Aug. 18, 1975, Pat. No. 4,040,226.

[30] Foreign Application Priority Data

Aug. 23, 1974 [SE] Sweden ..... 7410741
Sep. 3, 1974 [SE] Sweden ..... 7411139

[51] Int. Cl.[2] ..... B28B 3/12

[52] U.S. Cl. ..... 425/219; 425/220; 425/261; 425/363

[58] Field of Search ..... 425/218–220, 425/261, 374, 385, 363

[56] References Cited

U.S. PATENT DOCUMENTS

| | | | |
|---|---|---|---|
| 308,577 | 11/1884 | Richards | 52/593 X |
| 903,906 | 11/1908 | Soss | 52/594 |
| 981,219 | 1/1911 | Olsen et al. | 425/261 |
| 1,377,188 | 5/1921 | Domine | 425/218 |
| 2,271,030 | 1/1942 | Palanti | 52/591 |
| 2,586,714 | 2/1952 | Richardson et al. | 425/374 |

FOREIGN PATENT DOCUMENTS

| | | | |
|---|---|---|---|
| 853,757 | 12/1939 | France | 52/590 |
| 929,129 | 6/1947 | France | 52/279 |
| 1,070,750 | 2/1954 | France | 52/284 |
| 846,452 | 8/1952 | Fed. Rep. of Germany | 52/594 |
| 877,663 | 5/1953 | Fed. Rep. of Germany | 52/286 |
| 15,028 | 7/1897 | Switzerland | 52/593 |
| 515,842 | 12/1939 | United Kingdom | 52/590 |
| 537,153 | 6/1941 | United Kingdom | 52/594 |

*Primary Examiner*—Francis S. Husar
*Assistant Examiner*—John McQuade
*Attorney, Agent, or Firm*—Flynn & Frishauf

[57] ABSTRACT

A building block is disclosed which is intended to be arranged in substantially horizontal layers stacked upon each other without the use of mortar. The upper and lower support surfaces of the blocks are wave-shaped in two perpendicular directions in such a manner that the wave-patterns in both directions have the same amplitude and periodicity and a constant wave section over their entire extension. Disclosed also is apparatus for manufacturing the blocks, comprising at least one mold which has a bottom surface having a wave-shape corresponding to that of the block and an upper edge profile corresponding to the wave-shape of the top of the block in the longitudinal direction of the block. Means is located above the mold for supplying a casting mass to the mold and a rotary and vertically movable roll is located above the mold for levelling out and smoothing the mass at the upper end of the mold. The roll has means for cooperating with the wave-shaped upper edge profile of the sidewalls of the mold, the roll having a profile corresponding to the desired wave-shape of the block in a direction perpendicular to the longitudinal direction of the mold.

14 Claims, 8 Drawing Figures

APPARATUS FOR MANUFACTURING WAVE-SHAPE BUILDING BLOCKS

This is a division of application Ser. No. 605,314, filed Aug. 18, 1975, now U.S. Pat. No. 4,040,226.

The invention relates to apparatus for manufacturing a building block of the kind intended to be arranged in substantially horizontal layers stacked upon each other, the upper and the lower defining surfaces of the block being in parallel relative to each other.

The building industry demands new building elements, which are as easy to handle and as flexible in use as conventional building stones, but permit the application of more rational building methods. The erection of walls by means of conventional building stones requires several tedious operations. One such operation is, for example, that the individual stones upon their assembly must be jointed individually with mortar, or special locking members must be inserted manually into the joints. Jointing with mortar is a time-consuming operation, which requires high professional skill for obtaining a good result. The use of separate locking members involves an extra operation, which readily is neglected, and there is no possibility of checking at a final inspection whether this operation was carried out or not. Moreover, a supply of locking members must always be taken along during the assembly work.

In Swedish patent specification No. 352,914 a building block of the hollow type is described, at which each lateral part includes a portion which is vertically offset a small distance to form projecting mounting flanges in one of the horizontal defining surfaces of the block and corresponding grooves in the other horizontal defining surface. Blocks of this kind can be assembled without the use of mortar, but they require special fitting pieces at corner terminations such as corners, window-splays and the like. With this type of block, furthermore, no special fixing effect preventing longitudinal displacement of the blocks relative to each other is obtained.

It is the object of the present invention to provide apparatus for manufacturing a building block, which can be assembled without the use of joint mortar, and which renders possible simple corner terminations as well as fixing both in length and width direction.

SUMMARY OF THE INVENTION

The block manufactured according to the invention is designed so that the different layers can be laid offset and thereby form bonds also at corners. This is achieved in that the upper and lower support surfaces of the blocks are given a wave-shape in two substantially perpendicular directions, and that the wave-patterns in both directions have the same amplitude and periodicity and a constant wave section. For blocks with rectangular surfaces, said directions coincide with the length and, respectively, width direction of the blocks.

For being able to arbitrarily turn the blocks, they suitably are designed so that the wave-patterns in said directions comprise an integral number of periods. The wave-pattern in the transverse direction of the blocks preferably comprises one single integral period.

In accordance with the present invention the blocks are moulded by supplying a casting mass to molds both the bottom surfaces and the upper edge surfaces of the defining walls of the molds having a shape corresponding to the wave-shape of the blocks. The casting mass is levelled out and smoothed at the upper end of the mold by means of a rotary and vertically movable roll, which co-operates with the wave-shaped section of the longitudinal side edges of the mold, the movable roll having a section corresponding to the wave-shape in the transverse direction of the block.

DETAILED DESCRIPTION

Figure 1:
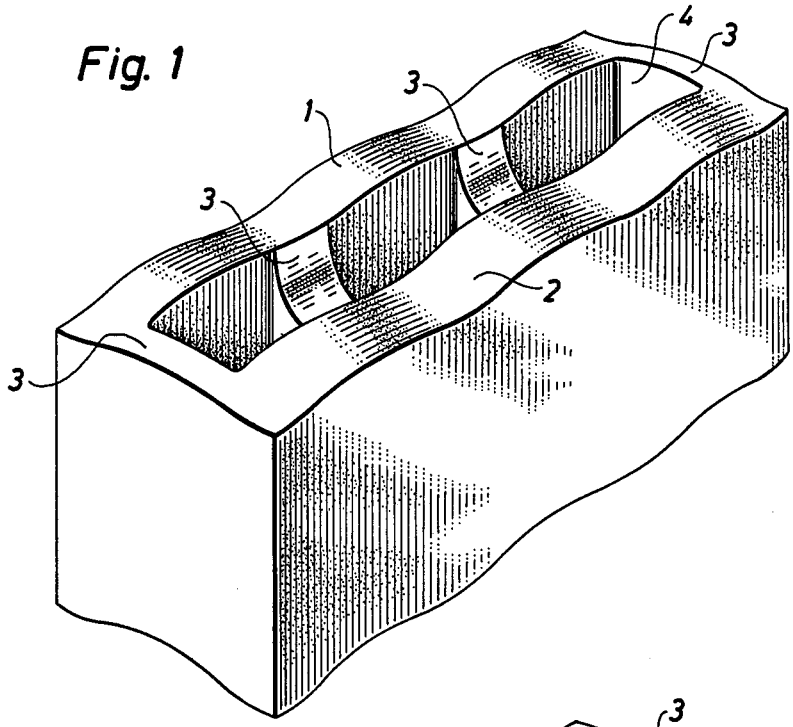
FIG. 1 is a perspective view of a block manufactured according to the invention, its upper surface facing upward.
Figure 2:
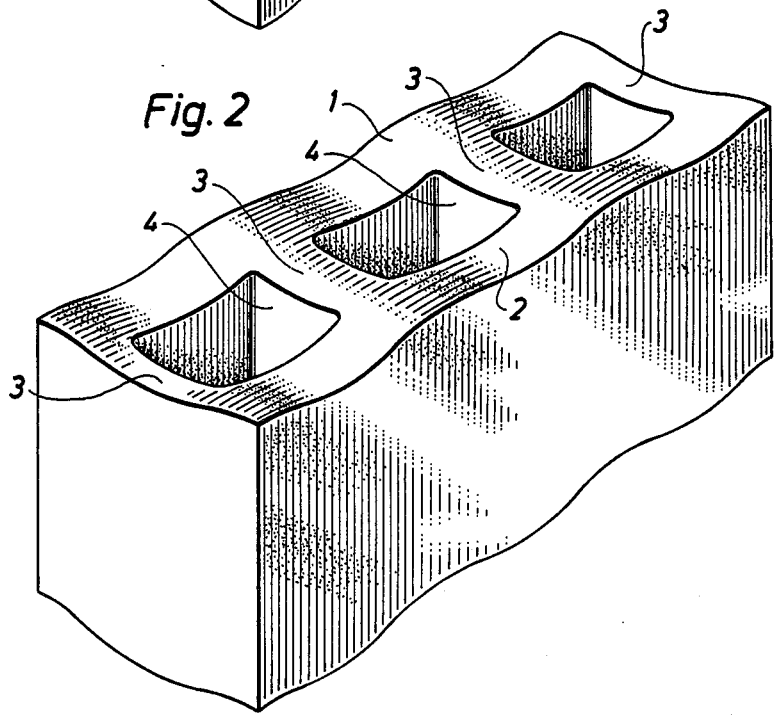
FIG. 2 is a view corresponding to FIG. 1, but with the lower surface of the block facing upward.

The block according to FIGS. 1 and 2 comprises two longitudinal parallel lateral pieces 1 and, respectively, 2 which are spaced apart by cross-pieces 3. The cross-pieces at the end edges of the block have a thickness corresponding to only half the thickness of the cross-pieces therebetween, thereby forming centrally in the block a number of vertical passages 4, which at different applications, can be utilized, for example, for receiving concrete mortar or insulation, or for the laying of pipes or electric cables. For rendering it possible to lay conduits also in the horizontal direction, the inner cross-pieces can be given a lower height than the lateral pieces, as shown in FIG. 1, so that upon the assembly a horizontal passage is formed in the defining surfaces between the different layers. Where appropriate, the thinner outer cross-pieces 3 of the blocks can at the building site be removed to the extent desired.

According to the invention, the upper and lower support surfaces of the block are wave-shaped both in the longitudinal and transverse direction. The periodicity and the amplitude of the waviness are in both directions the same, and the waviness of the upper surface is entirely in "phase" with the waviness of the lower surface, i.e. said surfaces are still entirely in parallel. Both wave-patterns, furthermore, have a constant wave section over their entire extension. The length of the block in the embodiment shown corresponds to three integral periods while its width corresponds to one period. The number of periods, however, can be chosen as desired. In order to be able to arbitrarily turn and position the blocks during their assembly, it is important that both the length and the width of the block correspond to an integral number of periods for the wave-shape in question. For hollow blocks the period length and the holes are so to be adjusted to each other, that at bonded assembly of the blocks vertical passages are obtained which extend through the entire height of the structure.

Figure 3:
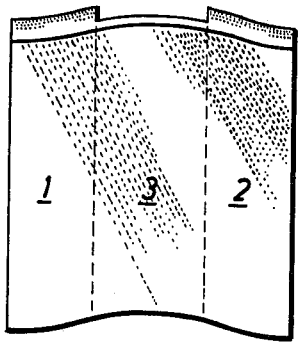
FIG. 3 is an end view of the block according to FIGS. 1 and 2.
Figure 4:
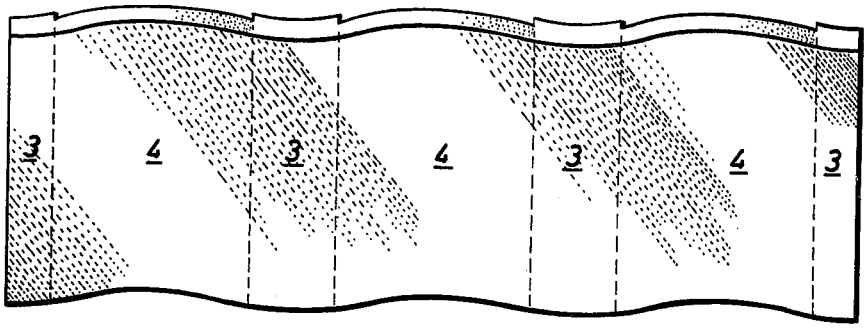
FIG. 4 is a side view of the block according to FIGS. 1 and 2.

In FIGS. 3 and 4 the block section is shown from the end and, respectively, from the side. The waviness shown, thus, has substantially a sinusoidal shape, in such a manner, that the wave-shape in the transverse direction at the upper surface of the block has its maximum amplitude along the longitudinal central line of the block while the minimum amplitude is located adjacent the longitudinal lateral edges of the block. The wave-shape in the longitudinal direction of the upper surface of the block starts and, respectively, ends at the end edges of the block with a minimum amplitude, and there are three amplitude tops between the end edges of the block. The wave-shape at the lower surface of the block, thus, is complementary to the wave-shape at the upper surface. Said wave-shapes may in principle start and end in any arbitrary phase, but the embodiment shown offers substantial advantages, because it involves that all partial surfaces of the upper surface of the block have a certain inclination outward to the sides of the block and thereby render it difficult for water to penetrate into the defining surfaces between the different layers. The embodiment shown has the further advantage that the blocks when being stacked upon each other are given a very stable support.

Figure 5:
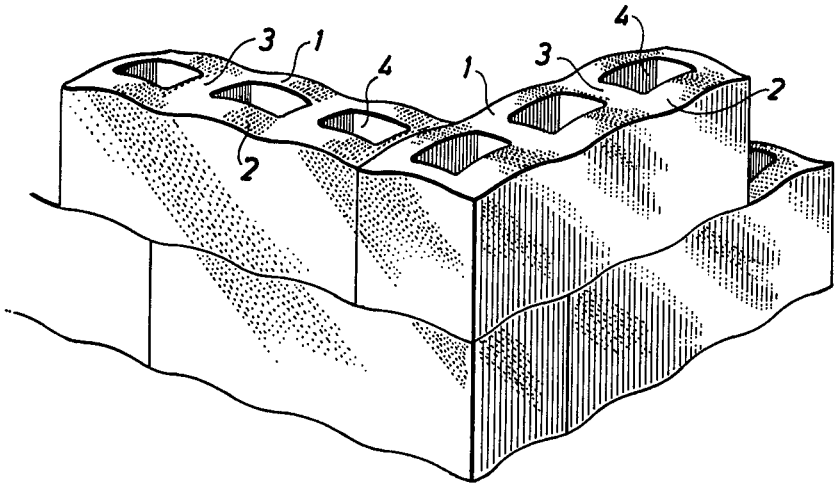
FIG. 5 shows a portion of a wall built of blocks according to the invention.

Blocks of the aforesaid design can, as shown in FIG. 5, be assembled by being stacked upon each other in horizontal layers. Due to their form, the blocks are thereby locked effectively in distinct positions. Since the lower and upper defining surfaces of the blocks are wave-shaped also in the transverse direction, the blocks can be arranged perpendicularly relative to each other, as shown at the corner in FIG. 5. By arranging the blocks bonded according to FIG. 5, a very stable wall structure is obtained at the same time as the probelm of terminations in corners and the like has been eliminated. By designing the blocks so that their length corresponds to an integral number of periods for the wave-shape, the blocks as already mentioned can be arbitrarily turned when they are being assembled. This requires also the width of the blocks to comprise an integral number of periods. The block described renders it also possible e.g. to connect inner walls to the outer walls 50 that blocks from the inner wall may pass out between blocks in the outer wall, as demonstrated at the corner shown in FIG. 5.

When erecting outer walls, it may be suitable to place two shell walls built of blocks according to the invention at a certain distance relative to each other so that the space therebetween can be filled with an unbroken insulation. The two shell walls can be anchored to each other by means of transverse brackets, which are connected to recesses provided for this purpose in the blocks already at their manufacture. For reason of clearness, however, such recesses are not shown in the drawings. When the material itself is insulating, two blocks may be positioned side by side or, alternatively, blocks with double thickness may be manufactured. Building blocks according to the invention can be applied, in addition to house walls, masonry walls and the like, also in connection with play and hobby work, because the principle of the invention to give the upper and lower defining surfaces of the blocks a wave-shape is not restricted to blocks of certain definite dimensions, but can be applied to blocks of different sizes to be assembled by being stacked upon each other.

The afore-described building block can be varied in several respects. The wave-shape shown, for example, can be exchanged against any other wave-shape as long as the periodicity and the amplitude thereof are the same in both the length and width directions of the block. The dimensions of the blocks in relation to the wave-shape may also be changed according to desire, so that, for example, also the width of the block corresponds to a plurality of integral periods for the wave-shape. The number and form of the vertical holes through the block are not concerned by the invention and may, of course, be varied according to desire. Also the geometric design of the block may, if desired, be changed to adapt to a special application.

Figure 6:
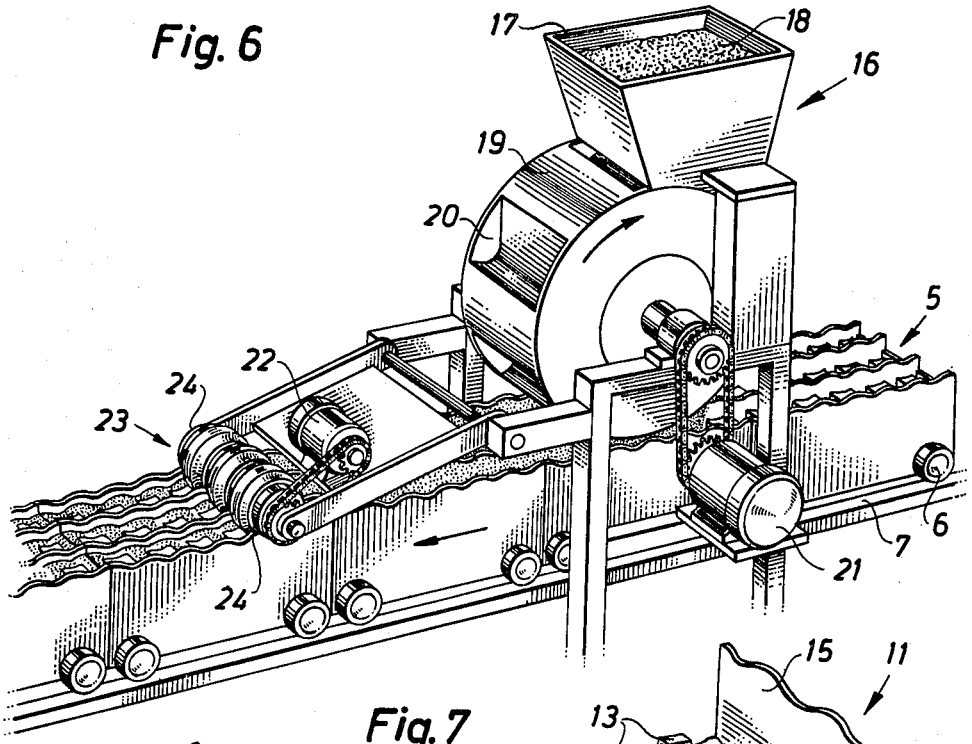
FIG. 6 is a perspective view of an apparatus for the manufacture of building blocks according to FIGS. 1 and 2.
Figure 7:
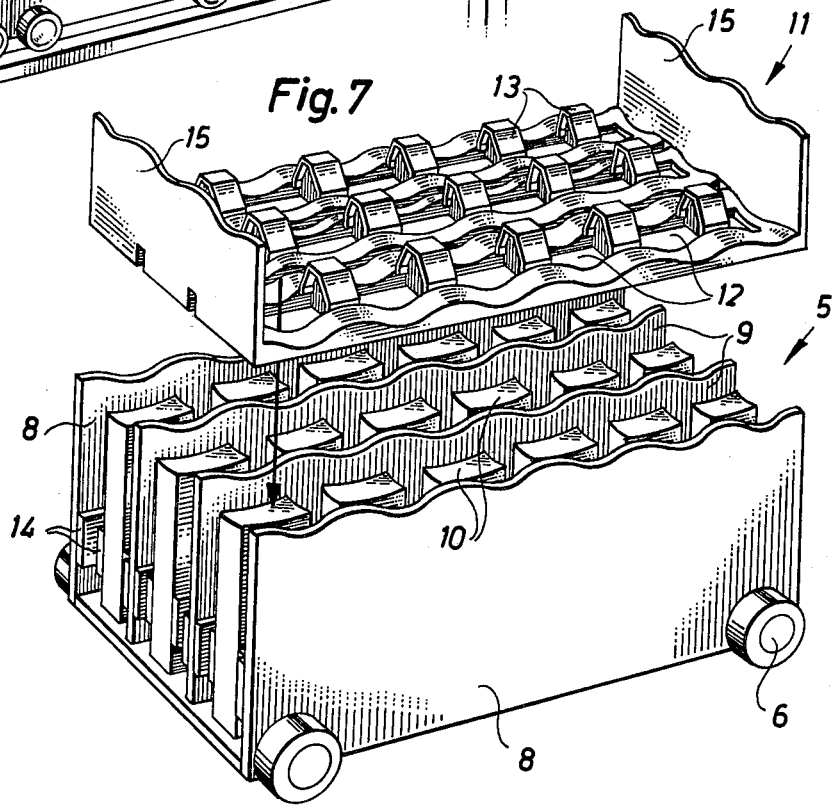
FIG. 7 is a perspective view of a manufacturing mold for blocks according to FIGS. 1 and 2, with a bottom plate in lifted position.

FIG. 6 shows an apparatus for the continuous manufacture of building blocks according to FIGS. 1 and 2. The apparatus comprises for this purpose a plurality of molds 5 in the form of carriages with wheels 6 rolling on rails 7. The molds 5 shown in FIG. 6 are each intended for simultaneously molding three blocks positioned beside each other. Each mold 5, as is more clearly apparent from FIG. 7, comprises two longitudinal outer sidewalls 8. The space between these sidewalls is divided by two inner defining walls 9 into three longitudinal sections, which are intended each for molding one block, and in each of which molding stakes 10 corresponding in number to the number of desired holes in the block are provided. The bottom and end walls of the mold 5 are formed by a separate plate 11 to be lowered into the mold. Said plate is provided with apertures 12 corresponding to the molding stakes 10 and is intended to rest upon longitudinal strips 14. Between said apertures, the plate is provided with upward projecting portions 13, which produce the aforesaid recesses in the inner cross-pieces in the blocks to form horizontal passages in the defining surfaces between the different layers. The upper surface of the block, thus, is formed by the plate 11 placed on the bottom of the mold.

The waviness of the upper support surfaces of the block as shown in FIG. 1 is brought about in that the corresponding surfaces of the plate 11 are given the desired waviness. In order to produce the desired waviness also on the lower support surfaces of the block, the sidewalls 8, partition walls 9, upper end surfaces of the mold stakes 10 and the end walls 15 of the plate 11 are provided with the corresponding waviness. The blocks are manufactured as follows.

The mold 5 in the form of carriages are first provided each with a plate 11 serving as bottom and end walls, and then are moved ahead on a path formed by the rails 7 to a filling station 16. The station comprises a storage hopper 17 containing the desired casting mass 18, for example concrete mortar. The hopper 17 is located above a rotary drum 19 provided with a plurality of cavities 20, which when upon rotation of the drum passing an opening in the lower part of the drum take along a certain quantity of the mass 18. The drum 19 is driven by a motor 21 at a relatively high number of revolutions, so that the molds 5 successively are filled as the material batches in the cavities are thrown down into the molds when they are passing beneath the drum 19. Owing to this batchwise filling, the molds are filled very well, so that the mass normally need not be vibrated, as it is necessary with other machines for the manufacture of building blocks. This elimination of vibration is a very substantial advantage.

The described filling device can be varied in several respects. The material bins, for example, can be arranged rotary about a substantially horizontal shaft in any desired manner, and the number and size of the material bins be varied as desired. The essential requirement, thus, is that the casting mass in a controlled manner batchwise and very forcefully can be thrown down into the mold to be filled. The molds are advanced either continuously or in steps pass the filling station.

The mold after having been filled with mass 18 pass a profiled roll 23, which is driven by a motor 22 at a high number of revolutions and provided with free-running rollers 24 co-operating with the upper wave-shaped edge surfaces of the sidewalls 8 of the mold 5, which surfaces act as cam surfaces. The roll is for this purpose pivotal in vertical direction.

Figure 8:
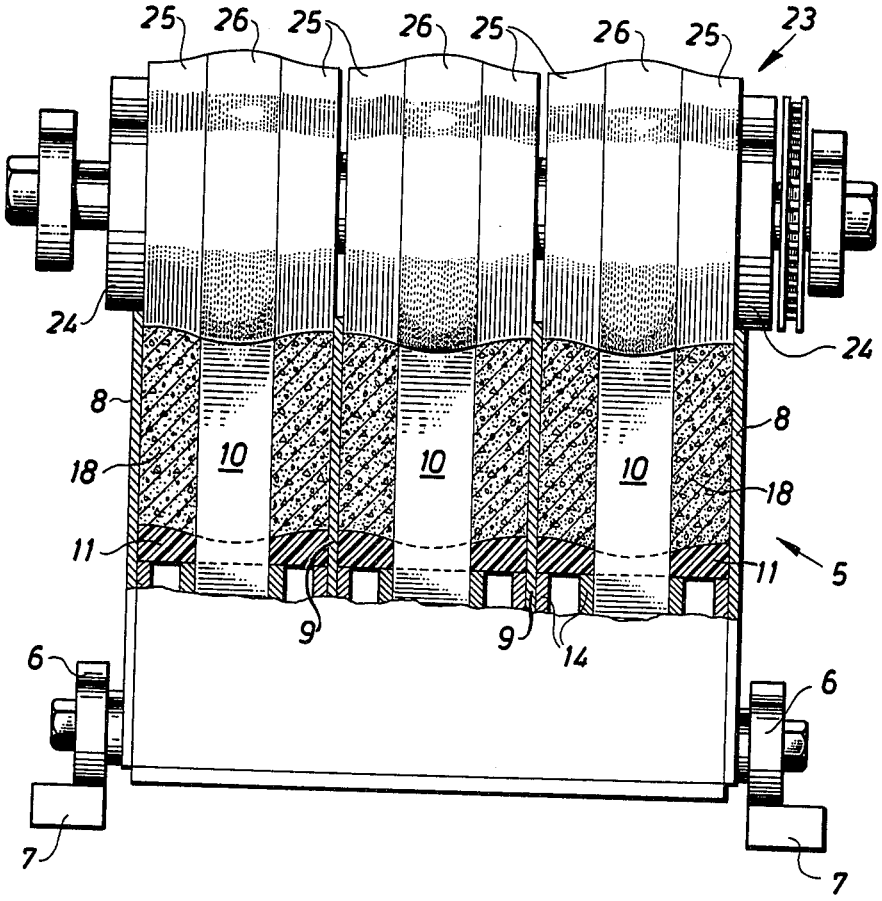
FIG. 8 is a front view of a portion of the apparatus according to FIG. 6, shown partly in section.

The profile of the roll 23, as can most clearly be seen in FIG. 8, corresponds to the desired wave-shape in the transverse direction of the blocks. The roll 23 comprises for each of the three longitudinal sections in each mold two outer sections 25, preferably of steel, which compress and smoothen the mass 18 fed into the mold. Between said sections a section 26 is provided which preferably is made of some softer material. Its primary object is to remove the mass 18 from the upper surface of the molding stakes 10 and to level the mass between said molding stakes.

Due to the fact that the roll 23 is adapted to follow the waviness of the outer walls of the molds 5 by co-operation between the free-running rollers 24 and the upper edge surfaces of said walls, and as the roll itself has a profile corresponding to the desired waviness, it is possible in a continuous manufacturing process also to obtain the desired wave-shape at the lower surfaces of the blocks which are turned upward in the molds. By driving the roll 23 at a relatively high number of revolutions, a very fine surface smoothness is obtained also at the lower defining surfaces of the blocks.

After the substance in the molds 5 has been levelled by means of the roll 23, the molds pass to a station where the molded blocks are removed from the molds by a relative displacement in vertical direction between the plates 11 and the molds 5. The blocks still supported on the plates can thereafter be conveyed to a suitable room for curing, whereafter they are removed from the plates 11, which then like the molds 5 are returned to the input end of the machine.

The apparatus described above can be varied in several respects.

The molds, for example, can be constructed for the simultaneous manufacture of a desired number of blocks having varying shape and varying positions for the vertical passages. Also homogeneous blocks can, of course, be manufactured. The molds may also be provided with end walls, in which case the end walls of the plates can be eliminated.

We claim:

1. Apparatus for manufacturing building blocks having a given wave-shape in two mutually transverse directions of the blocks, comprising:

at least one mold, the bottom surfaces of said mold having a shape corresponding to the wave-shape of the bottom of said blocks and the upper edge surfaces of the walls defining the longitudinal sidewalls of the mold having a wave-shaped upper edge profile corresponding to the wave-shape of the top of said blocks in the longitudinal direction of said blocks;

means located above said mold and operatively associated with said mold for supplying a casting mass to said at least one mold; and a rotary and vertically movable roll above said mold and operatively associated with said mold for levelling out and smoothing the mass at the upper end of said at least one mold, said roll being movable relative to said at least one mold in the longitudinal direction of said mold and including means for cooperating with said wave-shaped upper edge profile of said longitudinal sidewalls of said at least one mold and being further vertically movable relative to said at least one mold in accordance with said wave-shaped upper edge profile, said roll having a profile corresponding to the desired wave-shape of said block in the transverse direction of said mold relative to the longitudinal direction thereof.

2. Apparatus according to claim 1 wherein said at least one mold is movable along a path relative to said means for supplying a casting mass thereto.

3. Apparatus according to claim 2 comprising a plurality of said molds adjacent each other, and means operatively associated with said molds for moving said plurality of molds one after the other past and below said supplying means for supplying a casting mass to said plurality of molds.

4. Apparatus according to claim 3 wherein said means for supplying said casting mass to said molds comprises means for throwing down said mass batchwise into the respective molds.

5. Apparatus according to claim 4 wherein said means for supplying said casting mass to said molds comprises at least one casting mass receiving bin;

a substantially horizontal shaft means located above said molds;

means coupled to said receiving bin for rotating said receiving bin about said substantially horizontal shaft means; and means operatively associated with said receiving bin for filling said receiving bin with casting mass at one rotational position, said receiving bin throwing down said mass into a mold in a later rotational position by the action of the centrifugal force generated by said rotation thereof.

6. Apparatus according to claim 5 comprising a plurality of bins, each of which is operatively associated with said rotating means so as to be rotatable about said substantially horizontal shaft.

7. Apparatus according to claim 6 comprising a rotary drum having a shell surface defining said plurality of bins.

8. Apparatus according to claim 7 wherein said bins comprise cavities in said shell surface of said drum.

9. Apparatus according to claim 1 wherein said at least one mold includes a removable plate defining at least a portion of the bottom surfaces thereof, said removable plate being lowerable into said at least one mold.

10. Apparatus according to claim 11 wherein said removable plate defines at least a portion of the bottom surfaces of said mold and has a wave shape in both of said two transverse directions.

11. Apparatus according to claim 1 wherein said roll is fixed against substantial horizontal movement; while being vertically movable and said at least one mold is passed under said roll with said roll cooperating with said wave-shaped upper edge profile of the longitudinal sidewalls of said at least one mold.

12. Apparatus according to claim 11 further comprising means coupled to said roll for rotationally driving said roll as said at least one mold passes thereunder.

13. Apparatus according to claim 2 wherein said means for supplying said casting mass to said at least one mold comprises means for throwing down said mass batchwise into said at least one mold.

14. Apparatus according to claim 13 wherein said means for supplying said casting mass to said at least one mold comprises:

at least one casting mass receiving bin;

a substantially horizontal shaft means located above said at least one mold;

means coupled to said receiving bin for rotating said receiving bin about said substantially horizontal shaft means; and means for filling said receiving bin with casting mass at one rotational position, said receiving bin throwing down said mass into a mold in a later rotational position by the action of the centrifugal force generated by said rotation thereof.

* * * * *

UNITED STATES PATENT AND TRADEMARK OFFICE

CERTIFICATE OF CORRECTION

PATENT NO. : 4,101,255

DATED : July 18, 1978

INVENTOR(S) : Sven E. FERNAEUS et al

It is certified that error appears in the above-identified patent and that said Letters Patent are hereby corrected as shown below:

Column 6, line 54 (claim 10), change "claim 11" to --claim 9--.

Signed and Sealed this

*Third* Day of *April 1979*

[SEAL]

*Attest:*

RUTH C. MASON
*Attesting Officer*

DONALD W. BANNER
*Commissioner of Patents and Trademarks*